US006421030B1

(12) United States Patent
Oglesby

(10) Patent No.: US 6,421,030 B1
(45) Date of Patent: Jul. 16, 2002

(54) METHOD AND SYSTEM FOR MECHANICALLY AND ELECTRICALLY COUPLING AN ANTENNA

(75) Inventor: Stephen M. Oglesby, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/846,507

(22) Filed: May 1, 2001

(51) Int. Cl.[7] ..... H01Q 1/32; H01Q 9/16
(52) U.S. Cl. ..... 343/900; 343/702
(58) Field of Search ..... 343/900, 715, 343/820, 906, 904, 846, 702

(56) References Cited

U.S. PATENT DOCUMENTS 2,397,151 A * 3/1946 Mitchell ..... 250/33
3,977,005 A * 8/1976 Cejka ..... 343/702
4,504,834 A * 3/1985 Garay et al. ..... 343/749

* cited by examiner

*Primary Examiner*—Don Wong
*Assistant Examiner*—James Clinger
(74) *Attorney, Agent, or Firm*—Nathan O. Jensen; Kyle Eppele

(57) ABSTRACT

A system and method for mounting a slightly longer than ¼ wavelength whip antenna to a ground plane with an integrated electrical impedance match which uses a brass disk, threaded to the bottom portion of the whip and which is isolated for ground plane by a Delrin® acetal resin spacer, to provide a shunt capacitance.

13 Claims, 2 Drawing Sheets

METHOD AND SYSTEM FOR MECHANICALLY AND ELECTRICALLY COUPLING AN ANTENNA

FIELD OF THE INVENTION

The present invention generally relates to antennas, and more particularly relates to the mechanically and electrically coupling of an antenna, and even more particularly relates to methods and systems for providing an integrated electrical impedance match for a mechanical antenna mount.

BACKGROUND OF THE INVENTION

In recent years, the popularity of radio communications has continued to increase. With more demand for radio equipment, the competition between manufacturers and suppliers of radio communication equipment can likewise be expected to increase. One area in which these suppliers may compete is on the price and durability of such equipment.

Whip antennas are a common antenna type for many frequencies of radio communication. These antennas often are ¼ wavelength. Typically, these ¼ wavelength antennas have a different impedance from the impedance most desired by the radio. In such situations, it has been commonplace to include an impedance matching circuit disposed between the antenna and the radio. Often, such antennas will have the necessary impedance matching circuitry coupled to the antenna base or connector, etc.

While these whip antennas with impedance matching circuitry have been used extensively in the past, they do have some drawbacks. First of all, these impedance matching circuits add expense to the antenna. Secondly, these impedance matching circuits and their associated housing structures increase the bulk of the antenna, its connectors, mounts, or cabling.

Consequently, there exists a need for improved methods and systems for mechanically and electrically coupling an antenna in an efficient manner.

SUMMARY OF THE INVENTION

It is an object of the present invention to provide a system and method for mechanically and electrically coupling an antenna in an efficient manner.

It is a feature of the present invention to utilize an integrated shunt capacitance into an antenna mechanical mount.

It is another feature of the present invention to include a brass disk having a central feed aperture therethrough.

It is another feature of the present invention to have internal threading in said central feed aperture for receiving a threaded whip antenna therein.

It is an advantage of the present invention to achieve improved efficiency in mechanically mounting and electrically matching an antenna.

The present invention is an apparatus and method for mounting an antenna which is designed to satisfy the aforementioned needs, provide the previously stated objects, include the above-listed features, and achieve the already articulated advantages. The present invention is carried out in an "impedance matching circuitry-less" manner in a sense that the requirement for an impedance matching circuit between an antenna and a radio has been eliminated or greatly reduced.

Accordingly, the present invention is a system and method including a whip antenna having a shunt capacitance providing mounting disk coupled to the whip.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
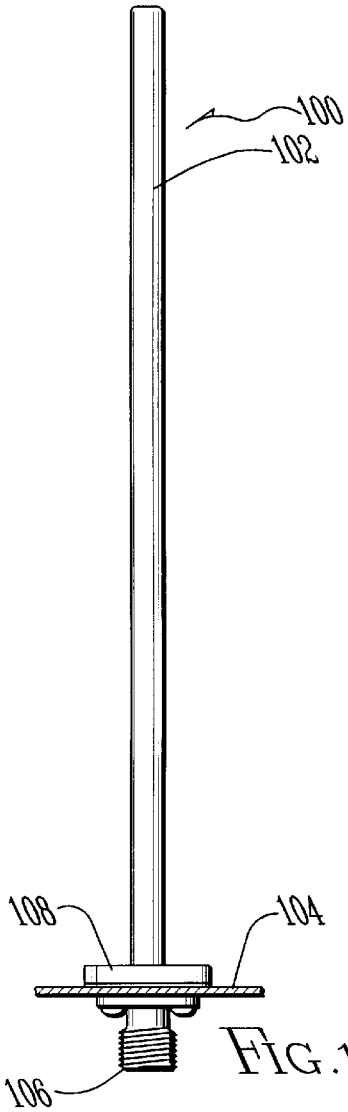
FIG. 1 is an elevation view of a whip and mounting system of the present invention.

Now referring to the drawings wherein like numerals refer to like matter throughout, and more specifically referring to FIG. 1, there is shown a system of the present invention generally designated 100, including a whip antenna 102 which may be any type or style of whip antenna. In a preferred embodiment, the whip antenna 102 would be slightly longer than ¼ wavelength, e.g., about ⅓ wavelength, depending upon the size of the ground plane 104. Coaxial cable connector 106 is disposed below the ground plane 104. The coaxial cable connector 106 is representative of any type of connector or feed. The ground plane may be any electrically large or arbitrary shaped ground plane. It is believed that a ½ wavelength by ½ wavelength ground plane is the smallest desirable ground plane.

Figure 2:
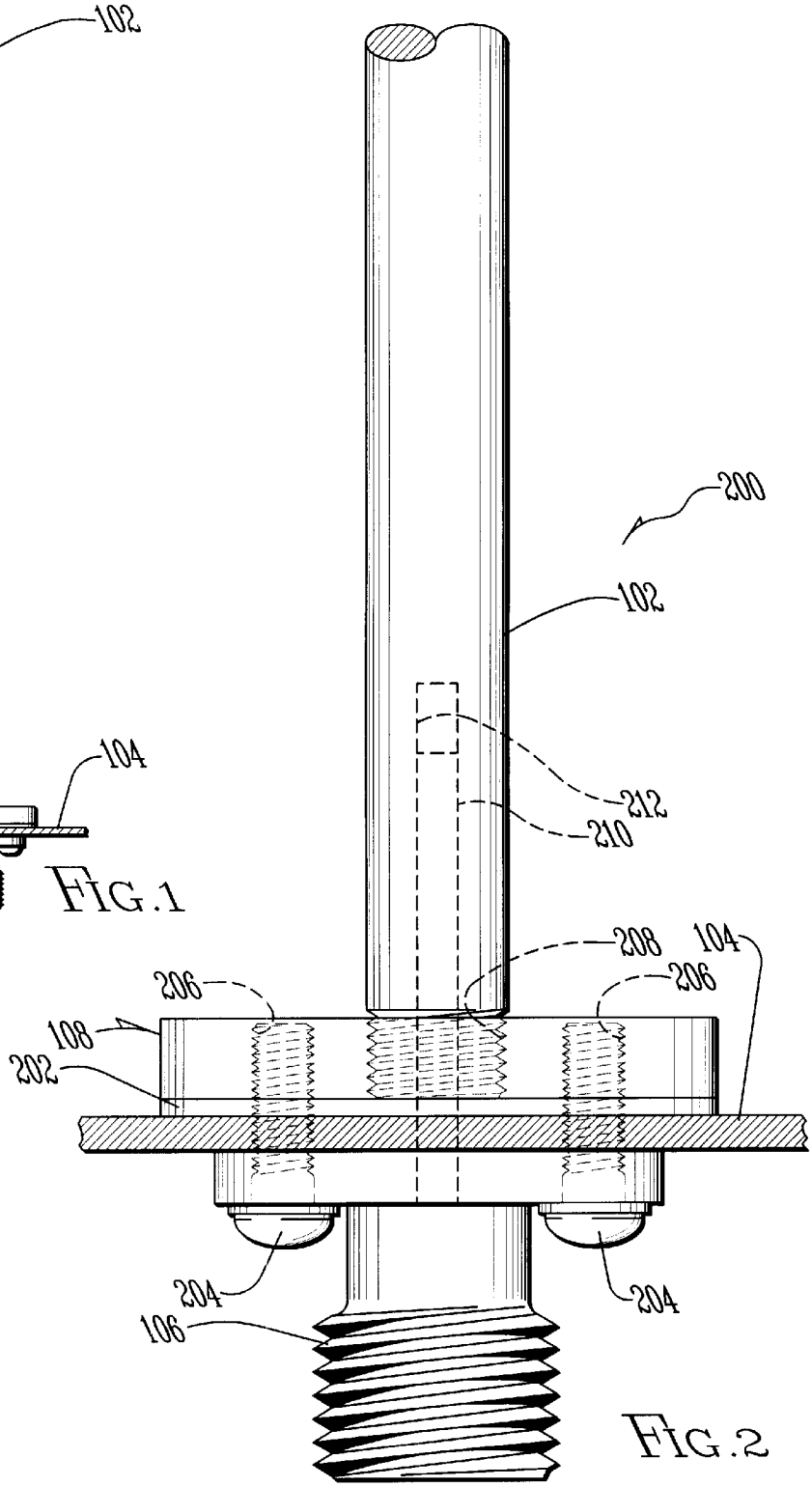
FIG. 2 is an enlarged elevation view of a portion of the whip and mounting system of FIG. 1.

A more detailed understanding of the present invention can be achieved by now referring to FIG. 2, which shows the lower portion of the whip antenna 102, generally designated 200, which includes a Delrin® acetal resin dielectric spacer disk 202 disposed between the brass shunt capacitance creating disk plate 108 and the ground plane 104. Delrin® acetal resin dielectric spacer disk 202 may actually be any type of dielectric. The material, i.e., the dielectric constant, as well as the thickness, can be tailored to provide sufficient shunt capacitance, depending upon the particular needs for each antenna. In a preferred embodiment, Delrin® acetal resin dielectric spacer disk 202 will have a central hole therein for receiving a feed probe 210 therethrough. Additionally, Delrin® acetal resin dielectric spacer disk 202 will have two additional holes therethrough for receiving nylon connector screws 204. The brass shunt capacitance creating disk plate 108 will also preferably have threaded screw-receiving holes 206 therein for receiving the nylon connector screws 204. Additionally, brass shunt capacitance creating disk plate 108 will have an internally threaded central hole 208 therein for receiving therein a threaded bottom portion of whip antenna 102. In a preferred embodiment, whip antenna 102 will have a feed probe receiving void 212 for receiving feed probe 210 therein. It should be understood that adhesive bonding techniques could be employed instead of nylon screws and threaded holes.

The dimensions of the components of the present invention are subject to various design decisions made by the antenna designer. The antenna of the present invention is scalable to other frequencies in accordance with the laws of electro-magnetics. The following dimensions are given as an example of one embodiment of the present invention for a particular antenna/radio combination. For a radio of approximately 450 MHz and for a whip antenna which would, absent the present invention, provide about a 20-ohm impedance and with a radio designed for a 50-ohm impedance: The thickness of Delrin® acetal resin dielectric spacer disk 202 would be 0.03; the diameter of brass shunt capacitance creating disk plate 108 and Delrin® acetal resin dielectric spacer disk 202 would be 0.625. The thickness of brass shunt capacitance creating disk plate 108 is 0.10, and the diameter of the whip antenna 102 is 0.156. All measurements are given in inches.

Figure 3:
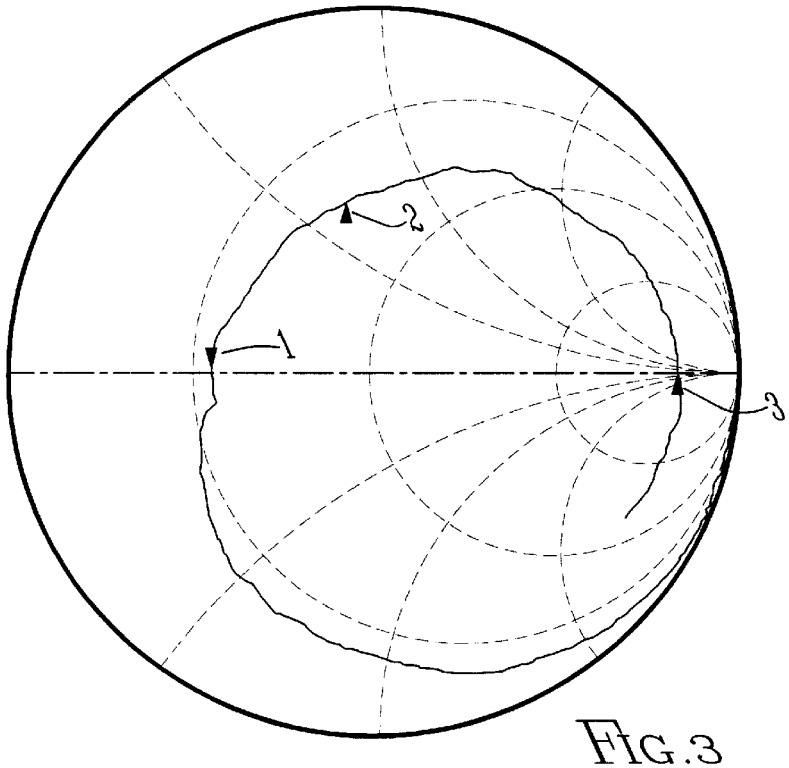
FIG. 3 is a Smith chart of the whip antenna 102 of FIG. 1 alone.
Figure 4:
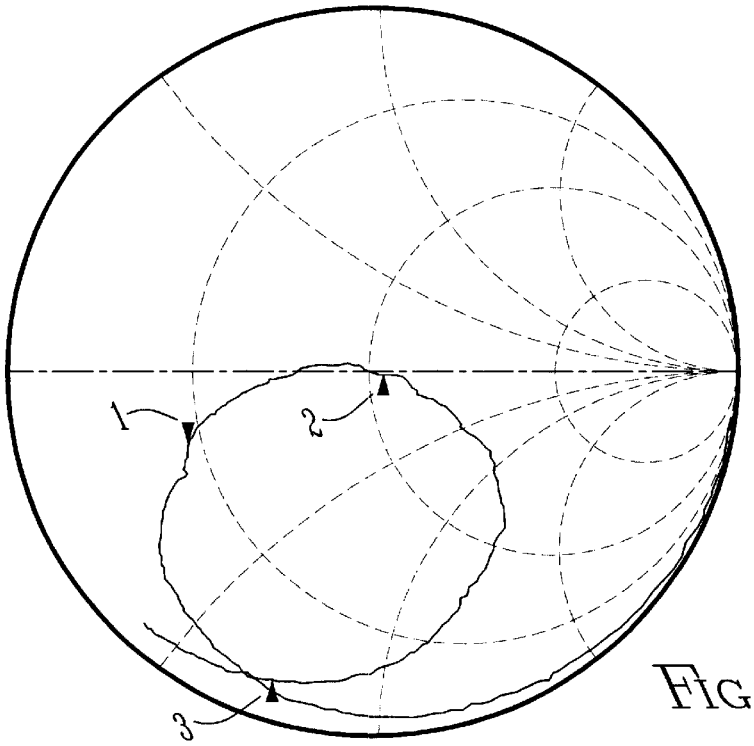
FIG. 4 is a Smith chart of the combined system of the present invention.

Now referring to FIG. 3, there is shown a Smith Chart, of the well-known type as first authored by Phillip H. Smith of Bell Labs. FIG. 3 includes 3 reference points. Point 1 relates to impedance load of the whip only at approximately 415 MHz, while point 2 relates to a frequency of 450 MHz, and point 3 to 695.5 MHz. The center of the equator line is normalized and is taken to be a 50-ohm load in this example. It can be seen that the whip alone is not at any frequency matched to the standard 50-ohm load. However, referring now to FIG. 4, there is shown a Smith chart prepared for the combination of the present invention. It can be seen that the plot does intersect the equator line at its midpoint. This point represents a frequency at which the antenna is matched to the load. Points 1, 2, and 3 represent the same frequencies as for FIG. 3. It can be readily seen that at 450 MHz, the combination of elements of the present invention result in a 50-ohm input antenna impedance for the assembly.

Throughout this description, reference is made to "near ¼ wavelength antennae" and to "coaxial cables" because it is believed that the beneficial aspects of the present invention would be most readily apparent when used in connection with such apparatus; however, it should be understood that the present invention is not intended to be so limited and should be hereby construed to include other lengths of antennas and other types of cabling as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. An apparatus for use with a radio having a predetermined antenna impedance requirement and a predetermined carrier frequency, the apparatus comprising:

a whip antenna, having a top end and a bottom end;

said bottom end of said whip antenna having a feed probe receiving void therein;

said bottom end of said whip antenna having a threaded outer surface;

a feed probe disposed in and soldered in said feed probe receiving void;

a brass disk, having a disk diameter, a disk ground plane side, a disk whip antenna side and a centrally disposed antenna hole therethrough extending from said disk ground plane side to said disk whip antenna side;

said antenna hole having internal threads therein for cooperating with said threaded outer surface of said whip antenna;

said brass disk further having a plurality of voids, disposed on the disk ground plane side, where said plurality of voids have screw receiving threads disposed therein;

a cylindrical acetal resin spacer having a space diameter which matches said disk diameter;

said cylindrical acetal spacer having a thickness characteristic and a dielectric constant characteristic;

said cylindrical acetal spacer having a plurality of holes therein, where at least two are in registration with said plurality of voids and at least one is in registration with said centrally disposed antenna hole of said brass disk;

a ground plane having a plurality of holes therein, where at least two are in registration with said plurality of voids and at least one is in registration with said centrally disposed antenna hole of said brass disk;

a coaxial connector for coupling with a coaxial cable, a portion of said coaxial connector being electrically coupled with said feed probe;

said coaxial connector disposed on an opposing side of said ground plane with respect to said whip antenna;

a plurality of non-conductive screws, extending through a portion of said coaxial connector, said ground plane, said cylindrical acetal spacer and into said plurality of voids, where external threads on said non-conductive screws cooperate with said screw receiving threads in said plurality of voids in said brass disk;

said whip antenna having a predetermined antenna impedance characteristic which is less than said predetermined antenna impedance requirement;

said whip antenna having an antenna length which is longer than ¼ wavelength of said predetermined carrier frequency;

said disk diameter, said thickness characteristic and said dielectric characteristic of said cylindrical acetal resin space are adjusted to provide a shunt capacitance which, when combined with the predetermined antenna impedance characteristic, results in an overall impedance, at said predetermined carrier frequency, which matches said predetermined antenna impedance requirement.

2. The apparatus of claim 1 wherein the predetermined carrier frequency is approximately 450 MHz.

3. The apparatus of claim 1 wherein the predetermined antenna impedance requirement is approximately (50+j0) ohms.

4. The apparatus of claim 1 wherein the disk diameter is approximately 0.625 inches.

5. The apparatus of claim 1 wherein the thickness characteristic is approximately 0.03 inches.

6. An apparatus for use with a radio having a predetermined antenna impedance requirement and a predetermined carrier frequency, the apparatus comprising:

a whip antenna, having a top end and a bottom end;

said bottom end of said whip antenna having a feed probe receiving void therein;

said bottom end of said whip antenna having a threaded outer surface;

a feed probe disposed in and attached to said feed probe receiving void;

a conductive disk, having a disk diameter, a disk ground plane side, a disk whip antenna side and a centrally disposed antenna hole therethrough extending from said disk ground plane side to said disk whip antenna side;

said antenna hole having internal threads therein for cooperating with said threaded outer surface of said whip antenna;

said conductive disk further having a plurality of voids, disposed on the disk ground plane side, wherein said plurality of voids have screw receiving threads disposed therein;

a cylindrical dielectric spacer having a space diameter which matches said disk diameter;

said cylindrical dielectric spacer having a thickness characteristic and a dielectric constant characteristic;

said cylindrical dielectric spacer having a plurality of holes therein, where at least two are in registration with said plurality of voids and at least one is in registration with said centrally disposed antenna hole of said conductive disk;

a ground plane having a plurality of holes therein, where at least two are in registration with said plurality of voids and at least one is in registration with said centrally disposed antenna hole of said conductive disk;

a connector for coupling with a conductive cable, a portion of said connector being electrically coupled with said feed probe;

said connector disposed on an opposing side of said ground plane with respect to said whip antenna;

a plurality of non-conductive screws, extending through a portion of said connector, said ground plane, said cylindrical dielectric spacer, and into said plurality of voids, where external threads on said non-conductive screws cooperate with said screw receiving threads in said plurality of voids in said conductive disk;

said whip antenna having a predetermined antenna impedance characteristic which is less than said predetermined antenna impedance requirement;

said whip antenna having an antenna length which is longer than ¼ wavelength of said predetermined carrier frequency;

said disk diameter, said thickness characteristic and said dielectric constant characteristic of said cylindrical dielectric spacer are selected to provide a shunt capacitance which, when combined with the predetermined antenna impedance characteristic, results in an overall impedance, at said predetermined carrier frequency, which matches said predetermined antenna impedance requirement.

7. The apparatus of claim 6, wherein the conductive disk is made of brass.

8. The apparatus of claim 6, wherein the cylindrical dielectric spacer is made of acetal.

9. The apparatus of claim 6, wherein the connector is a coaxial connector for coupling with a coaxial cable.

10. The apparatus of claim 6, wherein the predetermined carrier frequency is approximately 450 MHz.

11. The apparatus of claim 6, wherein the predetermined antenna impedance requirement is approximately (50+j0) ohms.

12. The apparatus of claim 6, wherein the disk diameter is approximately 0.625 inches.

13. The apparatus of claim 6 wherein the thickness characteristic is approximately 0.03 inches.

* * * * *